US005720850A

United States Patent [19]

Otten

[11] Patent Number: 5,720,850

[45] Date of Patent: Feb. 24, 1998

[54] PROCESS AND DEVICE FOR THE APPLICATION OF AN ADHESIVE

[75] Inventor: Adrianus Cornelis Otten, Tilberg, Netherlands

[73] Assignee: Nordson Corporation, Westlake, Ohio

[21] Appl. No.: 580,175

[22] Filed: Dec. 28, 1995

[30] Foreign Application Priority Data

Jun. 19, 1995 [NL] Netherlands ..... 1000593

[51] Int. Cl.[6] ..... B05B 15/02

[52] U.S. Cl. ..... 156/578; 156/389; 118/203; 239/106

[58] Field of Search ..... 156/578, 389, 156/547; 118/203, 302; 239/106, 112; 141/90

[56] References Cited

U.S. PATENT DOCUMENTS

| | | |
|---|---|---|
| 3,211,377 | 10/1965 | Brenner . |
| 3,876,144 | 4/1975 | Madden et al. . |
| 4,517,917 | 5/1985 | Santefort . |
| 4,814,794 | 3/1989 | Sato . |
| 5,344,073 | 9/1994 | Waryu et al. . |

FOREIGN PATENT DOCUMENTS

| | | |
|---|---|---|
| 8904727 | 6/1989 | European Pat. Off. . |
| 2200760 | 4/1974 | France . |
| 62-42668 | 9/1989 | Japan . |
| 4066158 | 6/1992 | Japan . |

*Primary Examiner*—James Engel
*Attorney, Agent, or Firm*—Wood, Herron & Evans, L.L.P.

[57] ABSTRACT

The invention pertains to a process for the operation of a mouthpiece for the intermittent supply of an adhesive through at least one discharge opening to a surface moving with respect to this mouthpiece, where at least in the pauses between discharges, the edges of the discharge openings are sprayed with a rinsing medium. The invention also pertains to a mouthpiece for the application of an adhesive with one or more rinsing medium discharge openings situated upstream from the glue discharge openings. As a result of these measures, glue residues are effectively prevented from accumulating at the edges of the discharge openings.

26 Claims, 3 Drawing Sheets

PROCESS AND DEVICE FOR THE APPLICATION OF AN ADHESIVE

BACKGROUND OF THE INVENTION

The application of an adhesive in the form of a specific pattern or line to a surface, such as the surface of parts to be glued to each other, by means of a mouthpiece which moves relative to the surface is known in practice. In this connection the problem occurs that, whenever the application is stopped, such as at the beginning of a pause in the discharge of the adhesive, residues of adhesive often remain hanging from the edge of the discharge opening. This leads to the phenomenon that is referred to in practice as the formation of "beards". The formation of these "beards" interferes with the good application of the adhesive, i.e., exclusively within the intended boundaries and in the previously specified quantity.

It is conceivable that the discharge openings could be cleaned periodically by switching the flow through the discharge opening from the adhesive to a flushing medium, but it is evident that such a solution is associated with many complications and is therefore unacceptable.

The invention provides a process by means of which the difficulty described above is eliminated. This process consists in that the edges of the discharge opening(s) are sprayed with a rinsing medium at least during the pauses between the applications of the glue.

The surprising discovery was made in practice that the formation of beards can be effectively prevented by means of this extremely simple measure.

It is preferable to supply the rinsing medium through at least one distributor, which, with respect to the discharge openings, is located upstream from the mouthpiece in the direction of motion and which produces a flat stream of the rinsing medium.

Especially good results are obtained when the adhesive is a cold glue and when water is used as the rinsing medium.

The invention also pertains to a mouthpiece with one or more rinsing medium discharge openings situated upstream from the glue discharge openings. This mouthpiece is preferably designed such that a rinsing medium discharge opening is protected by a cover plate situated a short distance away from the surface of the mouthpiece, the cover plate extending from the discharge opening to one or more adhesive discharge openings situated downstream therefrom, thus forming a flat distributor for the rinsing medium. The mouthpiece surface carries a thin plate with one or more cutouts opening toward the adhesive discharge openings, these cutouts being covered by a cover plate. Thus, a rinsing medium distributor of very simple design is obtained, the configuration and height of which is determined by the shape of the cutouts and by thickness of the plate, respectively, and can thus be easily and quickly adjusted to different conditions. The invention is explained on the basis of the drawings in which:

DETAILED DESCRIPTION OF THE PREFERRED EMBODIMENT

Figure 1:
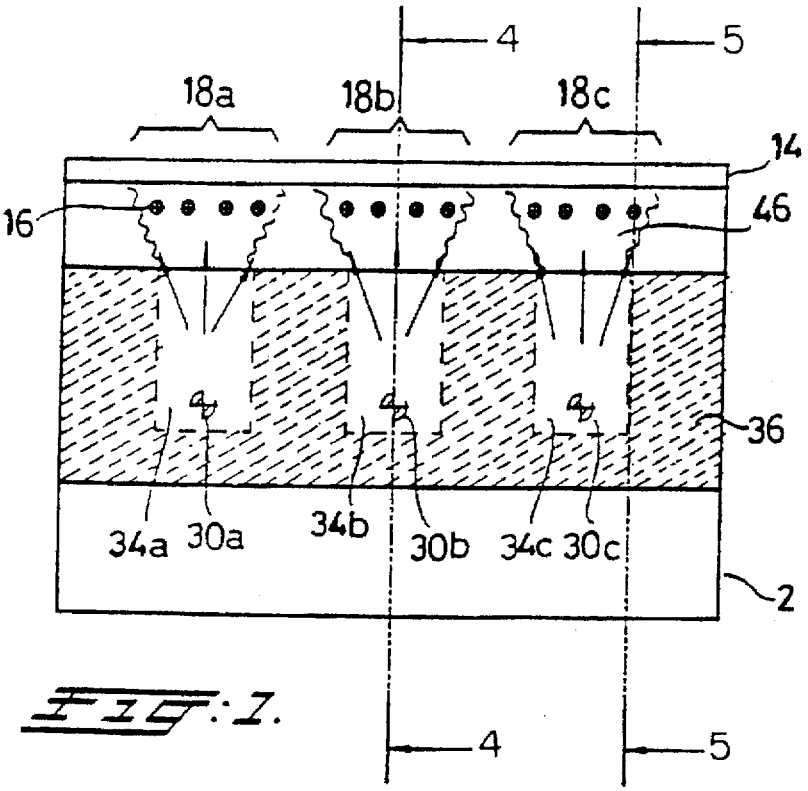
FIG. 1 shows a bottom view of the mouthpiece which embodies the features of the invention.
Figure 2:
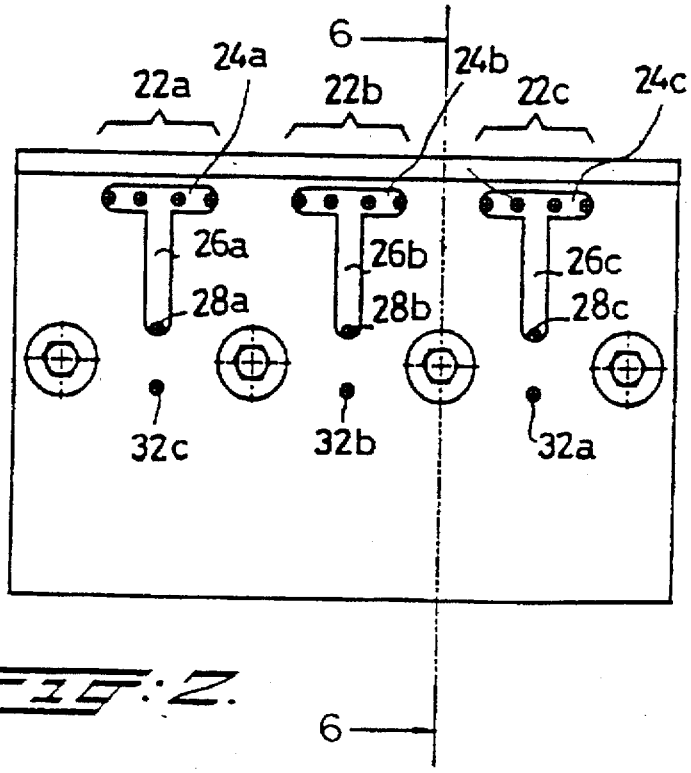
FIG. 2 shows a top view of the mouthpiece.
Figure 6:
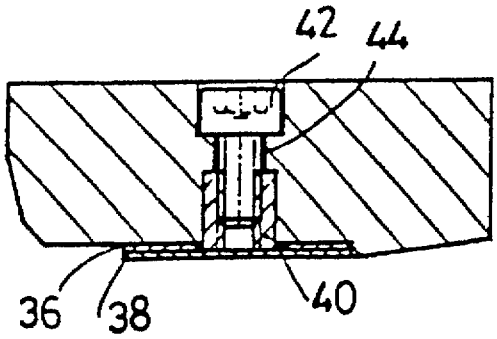
FIG. 6 shows a section through the mouthpiece along line VI—VI of FIG. 2.

An example of a mouthpiece which embodies the invention is designated as a whole in the ures by reference number 2. The design shown consists of a solid block 4, surface 6 of which passes by way of a sloping edge 8 and a receding edge 10 into surface 12. Next to rear edge 14 of surface 12, there is a series of adhesive discharge openings 16. In the embodiment shown, they are arranged in three groups 18*a*, 18*b*, 18*c* of four each. Naturally, the arrangement and the number of discharge openings are functions of the intended application, i.e., of the glue pattern to be applied to the substrate.

Figure 5:
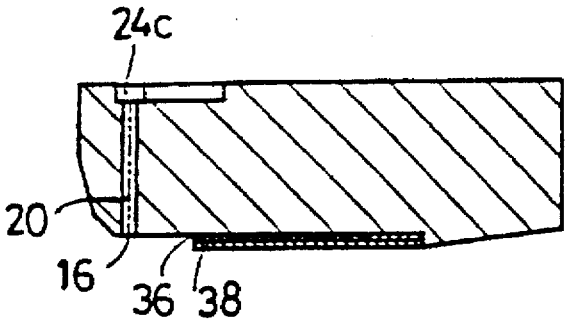
FIG. 5 shows a section through the mouthpiece along line VI—VI of FIG. 1.
Figure 4:
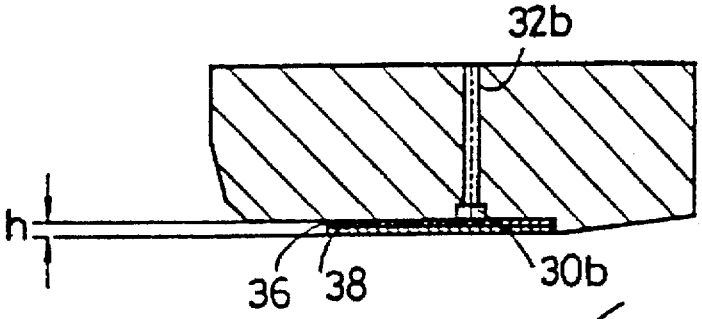
FIG. 4 shows a section through the mouthpiece along line IV—IV of FIG. 1.
Figure 3:
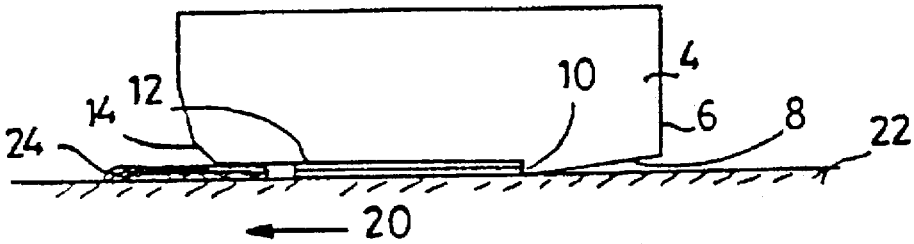
FIG. 3 shows a side view of the mouthpiece.

Each discharge opening 16 is the orifice of a channel 20 (see FIG. 5), and these channels 20 are thus also arranged in groups of four, i.e., groups 22*a*, 22*b*, 22*c*. The adhesive is supplied intermittently in a controlled manner in accordance with a previously defined pattern to the individual discharge openings 16 via feed openings 28*a*, 28*b*, 28*c*, connecting channels 26*a*, 26*b*, 26*c*, and distribution channels 24*a*, 24*b*, 24*c*, to which the connecting channels lead. From there, the glue is applied in the form of an adhesive "bead" 24, as shown in FIG. 3, to a substrate 22 traveling by under mouthpiece 4 in the direction of arrow 20. The thickness of bead 24 is determined by the height of edge 10, indicated as "h" in FIG. 4, by the size of the discharge opening, and by the pressure under which the adhesive is being supplied.

So that discharge openings 16 can be cleaned or, in accordance with the invention, "rinsed off" periodically, such as during pauses or intermittent shut-off periods, certain measures are provided in accordance with the invention. As seen upstream from openings 16 in the direction of arrow 20, surface 12 has three openings 30*a*, 30*b*, 30*c*, which are the orifices of feed channels 32*a*, 32*b*, 32*c*, through which a suitable rinsing medium such as water can be discharged intermittently in a controlled manner. So that this rinsing medium forms a flat sheet of mist to rinse openings 16, openings 30*a*, 30*b*, 30*c* are situated in rectangular cutouts 34*a*, 34*b*, 34*c* made in a thin plate 36 (for example, 0.1 mm thick), and this plate 36 is covered by a thin cover 38 with a thickness of, for example, 0.2 mm. The thickness of plate 36 plus the thickness of cover 38 is the same as height "h" of edge 10, that is, the distance between surface 12 and substrate 22. Cover 38 carries four internally threaded bushes 40, into which countersunk fastening screws 42, inserted through suitable bores 44 in block 4, are screwed. In this way, cover 38 is fastened to block 4 in an easily replaceable manner.

The rinse water supplied through openings 30*a*–30*c* forms flat streams proceeding in a single direction to rinse openings 16 as indicated in FIG. 1 by reference number 46.

Figure 7A:
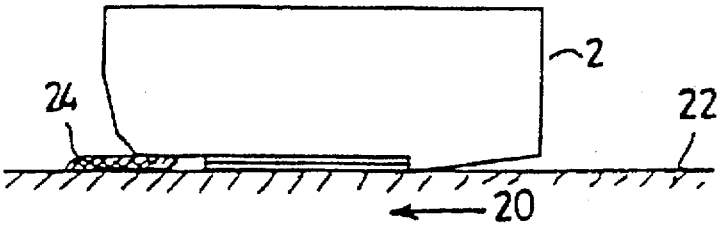
FIGS. 7A and 7B are side views of the mouthpiece in combination with a surface to which an adhesive is to be applied.
Figure 7B:
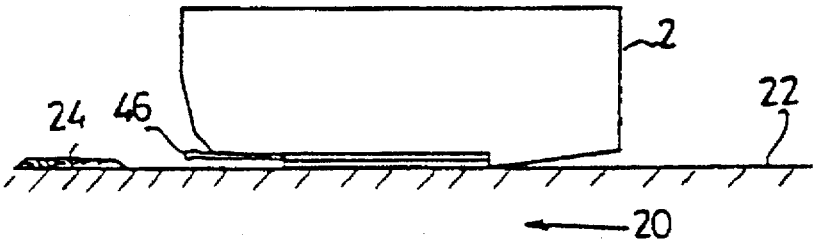

FIGS. 7A and 7B illustrate the effect of the measures according to the invention. FIG. 7A shows how mouthpiece 2 applies beads of adhesive 24 to substrate 22, moving continuously in the direction of arrow 20 under mouthpiece 2. Whenever the application of the adhesive is interrupted, a film 46 of water is sprayed via openings 30*a*–30*c* across openings 16, with the result that adhesive cannot accumulate at these orifices.

Figure 8:
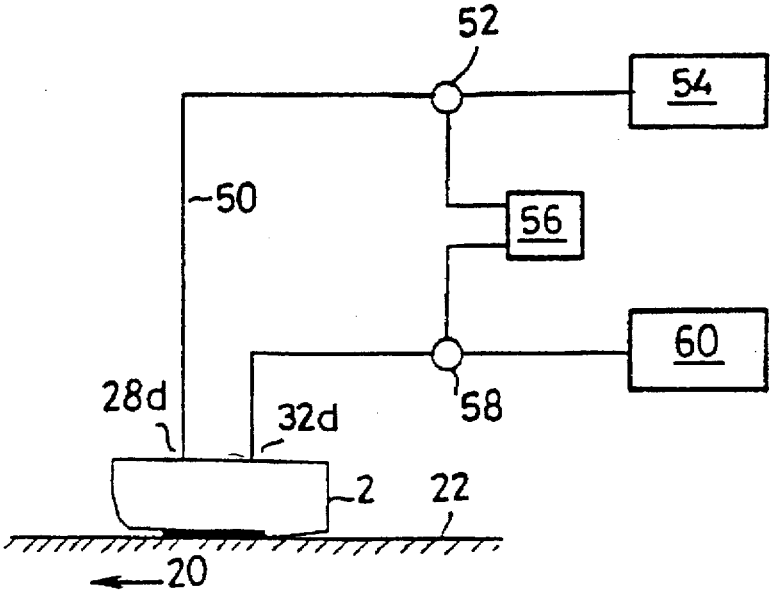
FIG. 8 is a diagram of an installation with a mouthpiece according to the invention.

FIG. 8 shows a highly schematic diagram of a complete installation in which the process according to the invention is implemented. The Figure shows mouthpiece 2 with common feed connection 28*d*, which leads to adhesive feed channels 28*a*–28*c*. Line 50 and valve 52 connect the feed connection to a schematically indicated source 54, from which adhesive is supplied; valve 52 is controlled by a schematically indicated central controller 56. Controller 56 also controls valve 58, which regulates the supply of rinse water from a schematically indicated source 60 to connection 32*d*, to which water channels 32*a*–32*c* are connected.

What is claimed is:

1. A device for applying adhesive to a relative moving surface, the device including a mouthpiece having at least one lower surface, at least one adhesive discharge opening in said lower surface and at least one rinsing medium discharge opening in said lower surface disposed upstream from said adhesive discharge opening and operatively aligned with said adhesive discharge opening, such that effluent from said rinsing medium discharge opening flows downstream toward said adhesive discharge opening.

2. The device of claim 1 wherein said rinsing medium discharge opening is a flat spray distributor which directs a flat spray of rinsing medium toward said adhesive discharge opening.

3. The device of claim 2 wherein said flat spray distributor includes a plate affixed to said lower surface of said mouthpiece and having a rinsing medium passage extending from said rinsing medium discharge opening toward said adhesive discharge opening.

4. The device of claim 3 wherein said plate is removably affixed to said mouthpiece.

5. A device for applying adhesive to a relatively moving surface, the device including a mouthpiece having at least one lower surface and at least one adhesive discharge opening in said surface, and at least one rinsing medium discharge opening disposed upstream from said adhesive discharge opening and directed toward said adhesive discharge opening;

wherein said rinsing medium discharge opening is a flat spray distributor which directs a flat spray of rinsing medium toward said adhesive discharge opening; and wherein said flat spray distributor includes first and second plates affixed to said lower surface of said mouthpiece and extending from said rinsing medium discharge opening disposed in said lower surface toward said adhesive discharge opening in said lower surface, said first plate including a cut out extending from said rinsing medium discharge opening to an edge of said first plate proximate said adhesive discharge opening and said second plate being a cover plate affixed over said first plate.

6. The device of claim 5 wherein said first and second plates are removably affixed to said mouthpiece.

7. A method for applying adhesive onto a surface through a mouthpiece having at least one lower surface having an adhesive discharge opening therein and said mouthpiece having a rinsing medium discharge opening a upstream of said adhesive discharge opening and in said lower surface, the method comprising the steps of:

moving the surface and the mouthpiece relative to each other;

intermittently supplying liquid adhesive through an adhesive discharge opening in said mouthpiece onto the surface, and spraying rinsing medium through said rinsing a medium discharge opening downstream at the adhesive discharge opening during pauses in the intermittent supplying of liquid adhesive.

8. The method of claim 7 wherein the spraying step further comprises directing a flat spray of rinsing medium in a downstream direction relative to the direction of movement of said surface.

9. The method of claim 7 wherein the rinsing medium is supplied through a distributor attached to said mouthpiece and located upstream from said adhesive discharge opening relative to the direction of movement of said surface.

10. The method of claim 7 wherein the liquid adhesive is a cold glue and the rinsing medium is water.

11. Dispensing apparatus for applying adhesive to a substrate where there is relative motion between the dispensing apparatus and the substrate so that said substrate moves downstream of said apparatus, and comprising:

a mouthpiece operably connectable to an adhesive source and to a rinsing medium source;

at least one lower surface on said mouthpiece;

at least one adhesive discharge opening disposed in said lower surface;

at least one rinsing medium discharge opening disposed in said lower surface upstream from said adhesive discharge opening;

wherein rinsing medium from said rinsing medium discharge opening can flow toward and over said adhesive discharge opening when rinsing medium is supplied to said mouthpiece.

12. Apparatus as in claim 11 wherein said mouthpiece lower surface comprises first and second portions disposed in two different planes, said openings being disposed in said first portion in one plane.

13. Apparatus as in claim 12 wherein said lower surface second portion is disposed in a second plane inclined upwardly and rearwardly in an upstream direction.

14. Apparatus as in claim 13 wherein said second portion has downstream and upstream ends and including a step between said first and second portions depending downwardly from said first portion to said downstream end of said second portion.

15. Apparatus as in claim 14 including a distribution plate disposed on said first portion and having a rinsing medium discharge passage extending from said rinsing medium discharge opening toward said at least one adhesive discharge opening.

16. Apparatus as in claim 15 including a grouped plurality of adhesive discharge openings, said rinsing medium discharge passage extending toward said grouped plurality of adhesive discharge openings.

17. Apparatus as in claim 15 including a cover plate disposed on said distribution plate and defining in part said rinsing medium discharge passageway.

18. Apparatus as in claim 15 wherein said plate is removably mounted over said first portion of said lower surface.

19. Apparatus as in claim 15 wherein said plate terminates in a downstream direction from said rinsing medium discharge opening before extending over said adhesive discharge opening.

20. An adhesive dispersing mouthpiece for applying adhesive to a substrate where there is relative downstream direction motion of said substrate with respect to said mouthpiece, said mouthpiece comprising:

a lower surface;

at least one group of adhesive discharge openings in said lower surface;

at least one rinsing medium discharge opening in said lower surface upstream of said group of adhesive discharge openings;

a rinsing medium discharge passage extending from said rinsing medium discharge opening toward said group of adhesive discharge openings, said discharge passage having an outlet oriented to spread rinsing medium across all adhesive discharge openings in said group.

21. A mouthpiece as in claim 20 wherein said adhesive discharge openings in a group extend across said lower surface in a direction transverse to said relative downstream motion and wherein said passageway outlet is narrower than the transverse extension of said group of adhesive discharge openings, and wider than any one of said adhesive discharge openings.

22. A mouthpiece as in claim 21 wherein said discharge passage is defined in part by a distribution plate extending from said rinsing medium discharge opening toward said group of adhesive discharge openings and terminating at an edge short of said group.

23. A mouthpiece as in claim 22 including a plate disposed on said distribution plate further defining said discharge passage.

24. A mouthpiece as in claim 23 including a plurality of groups of adhesive discharge openings, a respective rinsing medium discharge opening disposed upstream of each of said groups, and a plurality of respective discharge passages, one operatively extending from a respective rinsing medium discharge opening toward a respective group of adhesive discharge openings.

25. A mouthpiece as in claim 24 further including an adhesive distribution manifold common to each adhesive discharge openings in a respective group thereof.

26. A mouthpiece as in claim 23 wherein said lower surface comprises first and second portions, all said openings disposed in said first portion, a step depending from said first portion to an edge of said second portion and said second portion extending rearwardly upstream and inclining upwardly from said step.

* * * * *